United States Patent [19]

Gaspar et al.

[11] 4,095,780

[45] Jun. 20, 1978

[54] RETRACTING TUCKER BLADE AND BRUSH FOR CYLINDER FOLDER

[75] Inventors: Richard Allen Gaspar, Centerville; Robert Baxter Tarburton, Dayton, both of Ohio

[73] Assignee: Harris Corporation, Dayton, Ohio

[21] Appl. No.: 730,355

[22] Filed: Oct. 7, 1976

[51] Int. Cl.[2] ..... B65H 45/16

[52] U.S. Cl. ..... 270/73

[58] Field of Search ..... 270/70–77

[56] References Cited

U.S. PATENT DOCUMENTS

| | | | |
|---|---|---|---|
| 1,346,602 | 7/1920 | Johnston | 270/73 |
| 2,703,238 | 3/1955 | Hand | 270/73 |
| 2,856,184 | 10/1958 | Stobb | 270/73 |
| 3,182,991 | 5/1965 | Rodriques | 270/73 |
| 3,528,651 | 9/1970 | Eriksen | 270/73 |

FOREIGN PATENT DOCUMENTS

| | | | |
|---|---|---|---|
| 1,804,082 | 10/1969 | Germany | 270/73 |

*Primary Examiner*—Edgar S. Burr
*Assistant Examiner*—A. Heinz

[57] ABSTRACT

The tucker blade of a high speed cylinder folder for zig-zag folding a flexible web is retracted into the cylinder immediately after inserting the web into its opposed gripper. As the tucker blade is retracted a brush is extended to push the web gently away from the cylinder and to press the folded edge of the web toward the zig-zag stack.

5 Claims, 8 Drawing Figures

RETRACTING TUCKER BLADE AND BRUSH FOR CYLINDER FOLDER

BACKGROUND OF THE INVENTION

The present invention relates to folding apparatus, and more particularly to cylinder zig-zag folders such as described in U.S. Pat. No. 3,250,528, issued May 10, 1966 and assigned to the assignee of the present invention. Such folders use a pair of driven cylinders which are mounted with their axes of rotation in parallel adjacent relation. The outer cylindrical walls of the cylinders define a nip which receives the web, and gripper and tucker blades in the cylinder walls alternately fold and draw the web from the nip to deposit it in zig-zag fashion in a stack beneath the cylinders on a moving delivery table.

Folding machines such as that described in the above 3,250,528 patent have satisfactorily and accurately folded continuous, cross perforated webs at very high speeds. Further, since the principal motions are rotary, with very little reciprocating action, the design lends itself to operation at very high speed. Limitations are imposed, however, by the paper web itself, since at higher speeds (in excess of 800 ft./minute) it tends to cling to the surfaces of the cylinders. This problem is solved in part by the use of stripping pins, such as the stripping pins 87 shown in the above-noted 3,250,528 patent, which help separate the web from the cylinders. However, at higher speeds the tendency of the web to cling to the cylinders is so great that the web can actually fold back on itself and be covered by a subsequent fold causing a "dropped" fold in the stack. This is caused by two phenomena: (1) An electric charge between paper and cylinder and, (2) The relatively slow out flow of air from the triangular cavity formed by the folding cylinders and the stacked paper.

High speed movies have shown that after a fold is delivered by the gripper, it bounces off the bar which supports the stripping pins, and the folded edge sticks up and clings to the surface of the cylinder. In the prior art, the next tucker blade would then strike the folded edge urging it back down on the stack and preventing the edge from folding back on itself and being held that way by a subsequent fold.

When the blade strikes the folded edge of the form, however, it may damage the cross perforations, stretching them open in the web direction so that the paper does not feed satisfactorily through subsequent processing equipment, such as a line printer. Sometimes when the web folds back on itself, the blade may catch the web and jam it into the stripping pins as the cylinder continues to rotate. When this happens, the folder must be stopped and cleared, and the broken stripping pins must be replaced. Such accidents are therefore costly both in damaged material (tucker blades, pins, and webs) and in lost production time.

These problems are intermittent in nature, happening mostly at high speeds and depending on many variables, such as the size and weight of the web, temperature and humidity of the paper and the tendency of the paper to hold a curled shape as it is unwound from supply rolls. As operating speeds have become greater and greater, however, the problems have become more and more common, requiring improved means for firmly but gently separating the web from the cylinder without damaging the web, and for reliably and affirmatively laying the zig-zag folded web onto the delivery table.

SUMMARY OF THE INVENTION

Briefly, the present invention rotates each tucker blade to a retracted position as soon as it has inserted the web into and exited the gripper jaws on the opposing cylinder. The blade is retracted flush with the surface of its cylinder by a crank arm which pulls a follower through a closed cam raceway or "box" cam at the end of the cylinder. As the cylinder rotates, the cam raceway moves the follower back and forth about the axis of rotation of the tucker blade, causing the crank arm to rotate the tucker blade between its retracted and extended positions. This removes the tucker blades from possible contact with the web as the rotating cylinder continues to carry the blade around after it has tucked the web into the opposing gripper.

A compliant sweeper, such as a brush, is mounted on each tucker blade assembly adjacent and parallel to the blade and extending from one end of the cylinder to the other. The brush rotates simultaneously with the tucker blade but is rotationally located approximately 45° behind the blade. Thus, when the blade is extended, the brush is retracted beneath the cylinder surface, and when the blade assembly is rotated through approximately 30° to retract the blade, the brush is rotated from its retracted to an extended position in which it projects farther beyond the cylinder surface than the previously extended blade. The brush and blade are therefore alternately extended and retracted.

When the brush is extended, it will push along the air which is in front of it between the web and the cylinder. This cushion of air will aid in separating the web from the cylinder surfaces. The brush will also physically contact the web, helping to push air out from between folds in the web and to separate the web from the cylinder. As the brush moves with the cylinder and approaches the zig-zag stack beneath the cylinder, it will press the web down toward the stack, gently urging the folded edge of the web into proper position on the stack and helping to prevent the web from curling over backwards. Because of its compliant structure, the brush does not damage the perforations. The action provided by the brush is thus firm but gentle, so that the web is not accidentally caught and jammed into the stripping pins. The invention thus provides for substantial increases in operating speeds while eliminating bruises or other damage to the web and equipment.

It is therefore an object of the present invention to provide an improved cylinder folder construction; a cylinder folder in which the tucker blade is retracted immediately after inserting the web into its corresponding gripper to avoid further contact between the tucker blade and the web; in which a brush is extended when the blade is retracted to assist in separating the web from the cylinder, to lay the web down properly on the zig-zag stack, and to counteract the tendency of the web to curl over backward at its fold; and which will provide for substantial increases in operating speeds for such folders in an economical, reliable, and durable fashion.

Other objects and advantages of the invention will be apparent from the following description, the accompanying drawings and the appended claims.

DESCRIPTION OF THE PREFERRED EMBODIMENT

Figure 1:
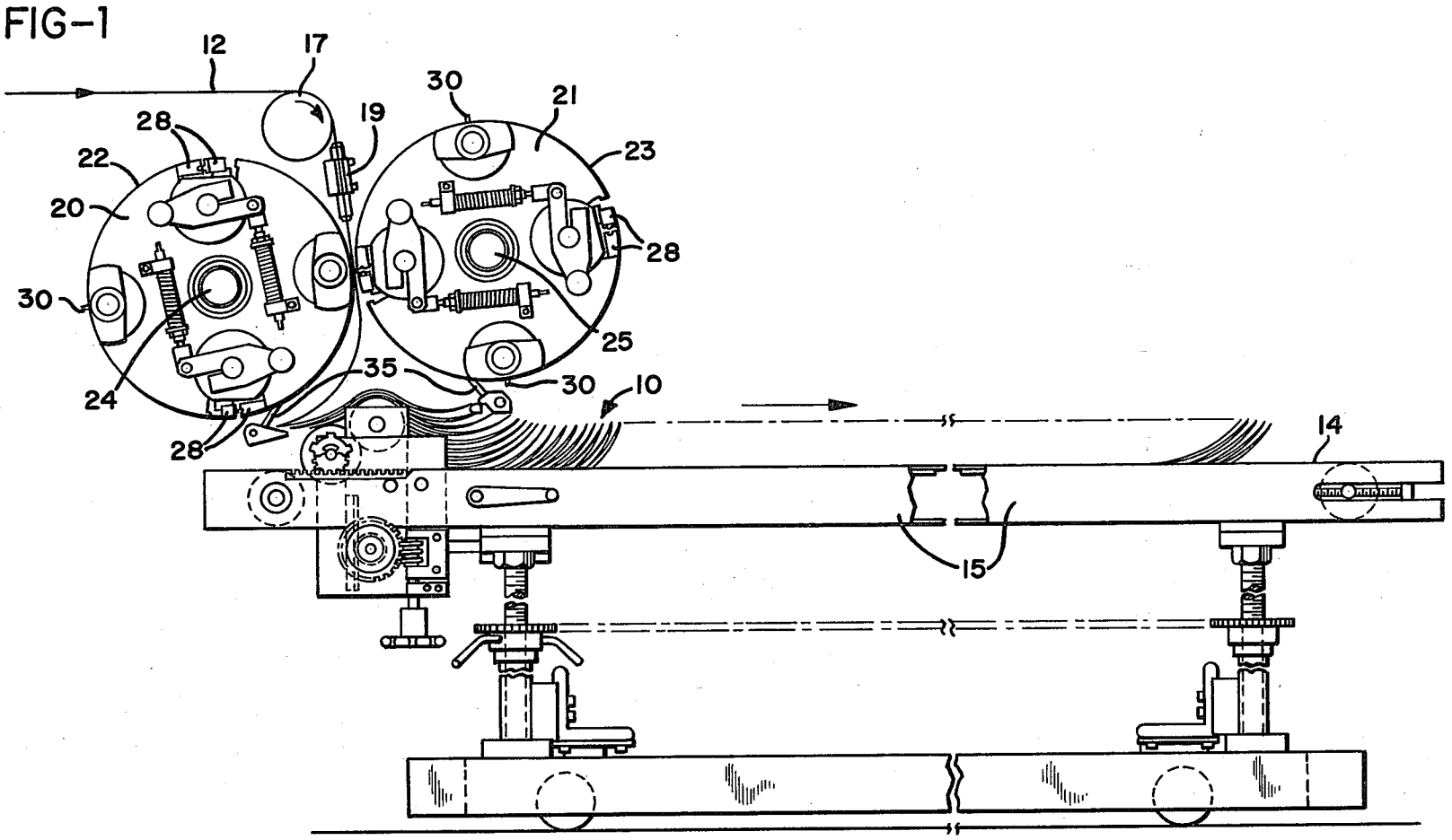
FIG. 1 is a somewhat schematic elevational view of a cylinder web folding apparatus incorporating the present invention.

Referring to the drawings, which illustrate a preferred embodiment of the present invention, FIG. 1 shows, in a somewhat schematic manner, the overall construction and arrangement of the folding apparatus and the path of the continuous zig-zag folds 10 of a web 12 as the folds are delivered along the supporting top 14 of a delivery table, generally referred to as 15.

In FIG. 1, the web 12 of paper is shown entering the folding machine in the upper left-hand corner as it is received from a printing press, or the like, and is directed over a power-driven roller 17 downwardly into a feed chute 19. The web is usually a single layer and is commonly provided with uniformly spaced perforations which lie transversely across the web and allow one form to be easily separated from an adjacent form.

A pair of folding cylinders 20 and 21 having outer cylindrical walls 22 and 23, respectively, are driven and supported on parallel drive shafts 24 and 25, with their axes of rotation in parallel adjacent relation. The drive shafts are supported in the side frames 26 (not shown) of the folding apparatus in conventional fashion. The cylinders 20 and 21 and their cylindrical walls 22 and 23 are counter-rotated at identical peripheral speeds. The cylinders define a nip therebetween which receives the web from the feed chute 19 and guides it downwardly to the top 14 of the delivery table 15.

Mounted longitudinally and diametrically opposite on each cylinder are pairs of folding jaws or grippers 28 which open and close in known fashion as the cylinders 20 and 21 are counter-rotated by their power source (not shown). Spaced 90° from the grippers 28 are longitudinally disposed pivotable tucker blades 30. The lengthwise mounted grippers 28 and tucker blades 30 are mounted in the walls 22 and 23 of the cylinders with each gripper on one cylinder being arranged in opposed gripping relation with a blade on the other cylinder, and vice versa, in known fashion. As the cylinders rotate, the blades 30 alternately tuck the web 12 into the grippers on alternate cylinders, preferably at the longitudinally spaced perforations along the web. The grippers 28 then close on the web, and the grippers are controlled in known fashion such that lengths of the web are pulled away from the nip and held by the grippers in contact with portions of the associated outer cylindrical walls 22 and 23. As each gripper 28 rotates to a position opposite table 15, it opens, releasing the web. In this way, the web is held in contact with a portion of the outer cylindrical wall of first one and then the other of the cylinders 20 and 21, and then released in this alternating fashion by the grippers 28, to form the zig-zag folds 10 of the web 12.

In operation, the grippers open slightly before they are rotated to positions opposite the delivery table 15, so that as the web folds engage a series of stripping pins 35, the pins assist in removing the web from contact with the outer cylindrical walls 22 and 23. The stripping pins 35 extend from outside the cylinders into recesses 37 in the outer cylindrical walls 22 and 23, and are positioned and operative to guide the folded web from the grippers and cylinders.

As operating speeds have increased, it has been found that not only does the web tend to cling to the cylinder above the stripping pins, but after removal from the cylinders the folded web tends to bounce off the bar which supports the stripping pins and to float momentarily above the zig-zag stack on the delivery table 15. Thus, in order to prevent the tucker blades 30 from damaging the web or jamming it between the stripping pins 35 and the outer cylinder walls 22 and 23, the tucker blades are rotated to retracted positions before they reach the stripping pins 35.

Figure 2:
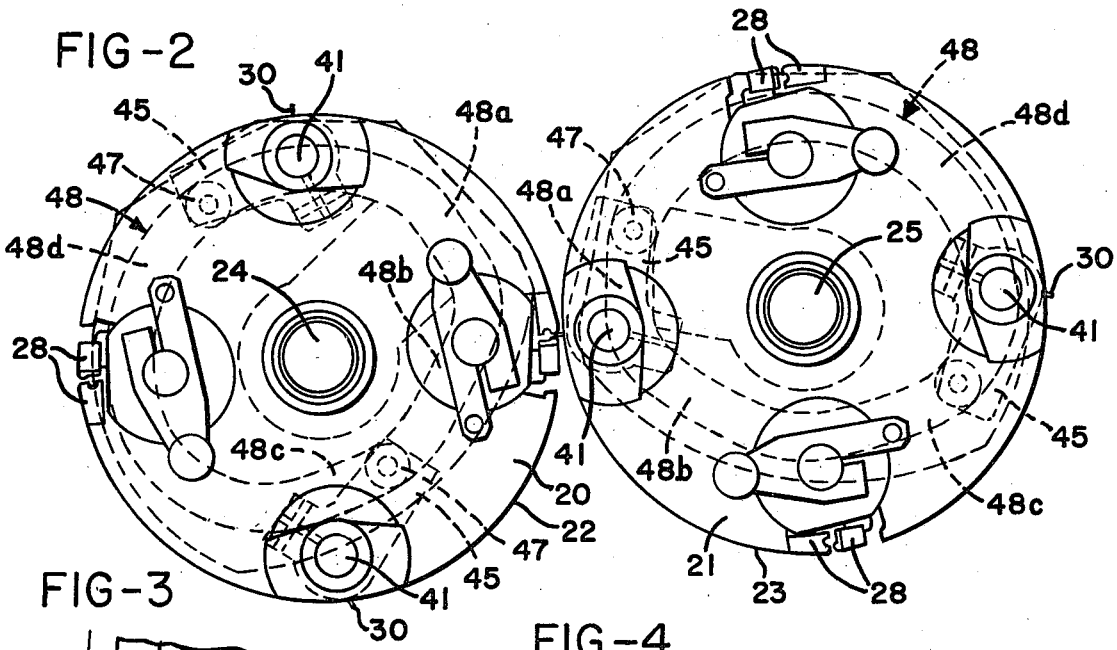
FIG. 2 is a side view of the folding cylinders, with the blade moving mechanism shown in phantom.

FIG. 2 illustrates the mechanism which rotates the tucker blades. The mechanism is similar to that set forth in the above noted U.S. Pat. No. 3,250,528. Thus, the tucker blades 30 are mounted in tucker blade supporting bars 40 which in turn are pivotally mounted at 41 in hollow recesses 42 in the ends of the folding cylinders 20 and 21. The pivots 41 mount the supporting bars 40 and tucker blades 30 for rotation on axes parallel to the axes of rotation of the drive shafts 24 and 25 of their respective cylinders. As is also clear from the drawings, the supporting bars 40 and their pivots 41 mount the tucker blades for retracting (FIGS. 4 and 8) and extending (FIGS. 3 and 6) movement at the surfaces of their respective cylinders.

The mechanism for retracting and extending the tucker blades 30 includes crank arms 45, one of which is attached to each of the supporting bars 40. As shown in the 3,250,528 patent, the crank arms 45 are moved about the pivots 41 by cam followers 47 pivotally supported on the end of each crank arm 45 opposite its supporting bar 40. The cam followers 47, in turn, are captured in closed cam raceways 48 which are mounted in stationary positions about the respective axes of rotation of the cylinders, as described in the above noted 3,250,528 patent. Thus, as the cylinders are rotated, their cam followers 47 are pulled by their crank arms 45 through the cam raceways 48, causing the crank arms 45, supporting bars 40 and tucker blades 30 to rotate between the retracted and extended tucker blade positions.

As shown in the above noted 3,250,528 patent, the cam raceways 48 include first segments 48*a* which move the cam followers 47 radially inwardly of the cylinders at a slow rate of speed. This moves the respective tucker blades 30 slowly in a direction opposite of the direction of rotation of their respective cylinders when the blades are engaging their opposed grippers on the other cylinder. The slow reverse movement of the blades retards the tip speeds of the blades to match the surface speed of the opposing cylinder, and hence the linear speed of the web 12 as it is being tucked into the opposing gripper 28.

Figure 3:
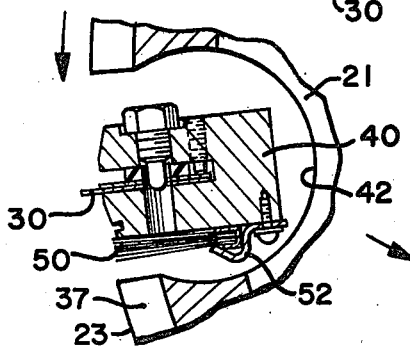
FIG. 3 is a fragmentary cross-sectional view of one of the tucker blade assemblies in the projected web tucking position in its cylinder, the tucker blade being sectioned on line 3—3 in FIG. 5.
Figure 4:
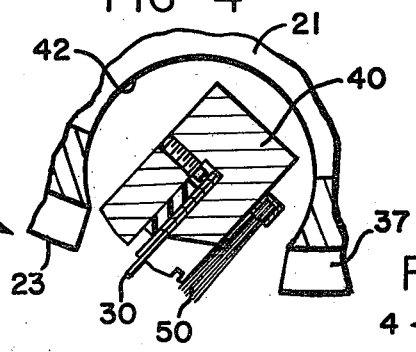
FIG. 4 is a view similar to FIG. 3 showing the cylinder and the tucker blade assembly moved to a position where the tucker blade is almost fully retracted and the brush almost fully extended, the tucker blade being sectioned on line 4—4 in FIG. 5.
Figure 6:
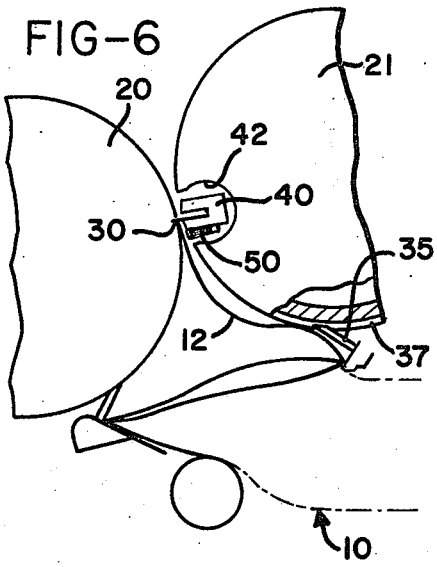
FIGS. 6–8 are successive schematic illustrations showing high speed rotation of a tucker blade and brush assembly on its cylinder, and their action upon the web during such operation.
Figure 7:
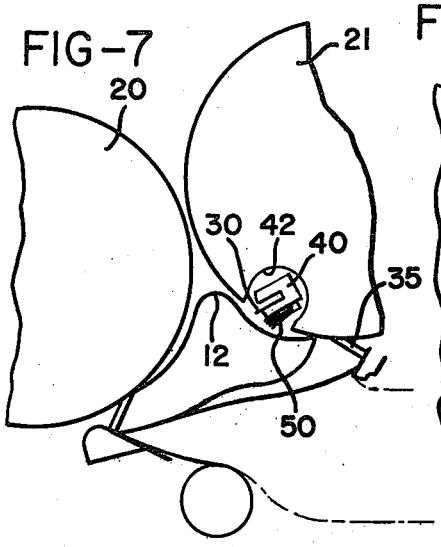
Figure 8:
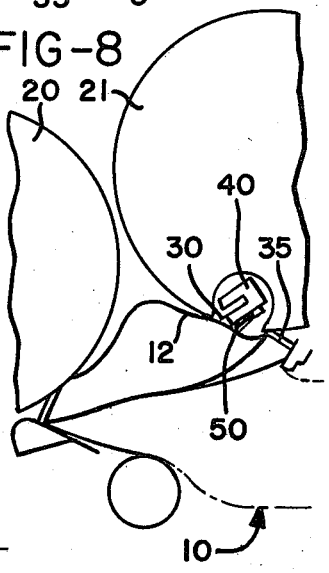

However, after each tucker blade in the 3,250,528 device leaves its opposing gripper jaws 28, the 3,250,528 device simply returns the tucker blade to its fully extended position. In contrast, following the first cam raceway segment 48*a* in the present invention, there is an abruptly steeper second segment 48*b* which assumes control of the movement of the tucker blades 30 as soon as they clear the grippers 28. Segment 48*b* quickly rotates the supporting bars 40 and the tucker blades 30 thereon through approximately 30° with respect to the folding cylinders 20 and 21 in which they are mounted. This effectively retracts the tucker blades 30 to a position nearly flush with the outer walls 22 and 23 of the folding cylinders 20 and 21. FIGS. 3 and 6 show the tucker blades extended in the tucking position. FIG. 7 shows the cylinder 21 partly advanced and a supporting bar 40 and blade 30 thereon partly retracted. FIG. 8 shows the cylinder 21 still further advanced, with the tucker blade almost to the stripping pins 35 and almost completely retracted.

After the tucker blades 30 pass the stripping pins 35, the cam followers 47 enter a third cam raceway segment 48*c* which rotates the supporting bars 40 back to their original positions. This returns the tucker blades 30 to their extended positions, and they are maintained in these positions by a fourth segment 48*d* of the cam raceway 48 until their cam followers 47 reenter the first segment 48*a*.

Figure 5:
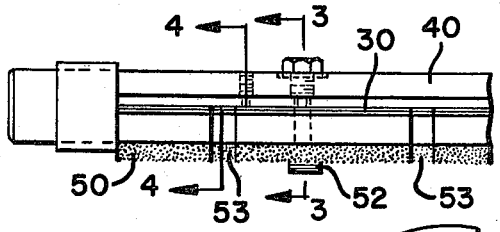
FIG. 5 is a top view of a portion of the tucker blade and brush assembly.

The present invention also includes compliant sweepers, such as brushes 50, which substantially improve the performance thereof. A brush 50 is mounted on each of the supporting bars 40 by a series of clips 52 so that the brushes move and rotate with their respective supporting bars 40. The brushes 50, which extend substantially from one end of each cylinder to the other, are thus mounted at their respective cylinder outer wall surfaces 22 and 23 near and parallel to their respective tucker blades 30. As illustrated, the brushes 50 are positioned on the supporting bars 40 so that the brushes are held in a retracted position (FIGS. 3 and 6) when the blades 30 are extended, and are moved to positions extending beyond the cylinder surfaces (FIGS. 4, 7 and 8) when the tucker blades 30 are moved to their retracted positions. As shown in FIG. 5, the brushes have notches 53 for clearing the stripping pins 35 as the brushes are rotated therepast.

As may be seen particularly in FIGS. 7 and 8, the brushes 50 substantially improve the separation of the web 12 from each cylinder surface, and provide satisfactory stacking of the web 12 on the top 14 of the delivery table 15 at substantially increased cylinder folder operating speeds. Each brush 50 actually contacts the web 12 and gently pushes and separates it from its cylinder surface. In this way the web is physically pushed down toward the stack, so that it is less likely to curl, bunch, or jam at the stripping pins 35. Even if part of the web 12 does float up to the junction between the stripping pins 35 and the outer wall of a folding cylinder as one of the brushes 50 is moving thereby, the web will not be jammed into the stripping pins 35 because the brush 50 is soft and resilient and will yield to the web rather than forcing it under the pins.

As may be seen, therefore, the present invention provides numerous advantages. It results in substantial savings by reducing equipment breakage and down time. The quality of the zig-zag folded web is also improved since the cross perforations are no longer stretched open at the folds. These advantages have made it possible to operate the folder at substantially greater speeds, while still enjoying the improved operation. The advantages are also provided with very little increase in cost over that of previous machines. Thus, the cam raceways 48 have been altered with the addition of the second segment 48*b*, and the brushes 50 have been added to the tucker blade supporting bars 40. These improvements, while uncomplicated and inexpensive, have resulted in notably improved machine performance.

While the form of apparatus herein described constitutes a preferred embodiment of this invention, it is to be understood that the invention is not limited to this precise form of apparatus, and that changes may be made therein without departing from the scope of the invention.

What is claimed is:

1. In apparatus for zig-zag folding a flexible web, including a pair of driven cylinders disposed in parallel adjacent relation and adapted to receive the web therebetween, cooperating tucker blade and gripper means on each cylinder and effective to fold and tuck the web alternately into the gripper means on alternate cylinders at longitudinally spaced intervals along the web in response to rotation of the cylinders, and stripper means cooperating with the gripper means for releasing and guiding the folded web from the gripper means and the cylinders, the improvement comprising:

(a) a compliant sweeper, and (b) means mounting said sweeper at a cylinder surface near a tucker blade and means within that cylinder for cyclically moving the sweeper to an extended position extending beyond the cylinder surface for contacting the web after the tucker blade has tucked the web into its associated gripper means and for maintaining said sweeper in said position extending beyond the cylinder surface after the gripper means on that cylinder has released the web thereon, for continuing to contact the web to aid the separation of the web from the cylinder surface and to protect it from the tucker blade.

2. In a high speed cylinder type folder for folding a continuous web in zig-zag fashion, the folder including a pair of driven cylinders having outer cylindrical walls and being mounted with their axes of rotation in parallel adjacent relation, the walls defining a nip adapted to receive the web therebetween, grippers and tucker blades mounted lengthwise in the walls of each cylinder, each gripper on one cylinder being arranged in opposed cooperating relation with a blade on the other cylinder, and vice versa, whereby the blades alternately tuck the web into the grippers on alternate cylinders at longitudinally spaced intervals along the web in response to rotation of the cylinders, the grippers being controlled such that lengths of the web are pulled away from the nip and held by the grippers in contact with portions of the associated outer cylindrical walls of first one and then the other of the cylinders before release of the grippers, and stripper means operative to guide the folded web from the grippers and cylinders upon release of the grippers, the improvement comprising:

(a) tucker blade mounting means mounting each tucker blade for rotation on axes parallel to the axes of rotation of their respective cylinders and mounting each tucker blade for retracting and extending movement on said mounting means at the surfaces of their respective cylinders, (b) means for rotating each tucker blade on its mounting means from a first position projecting beyond the surface of its respective cylinder when opposite the gripper means on the other cylinder to a second position retracted substantially flush with the surface of its respective cylinder when rotated beyond the position opposite the gripper means at its cylinder rotates, said tucker blade moving means further comprising a crank arm attached to each said tucker blade mounting means for rotating it and the tucker blade thereon as said crank arm is moved about the axis of rotation of its respective tucker blade mounting means, a cam raceway for each cylinder held in a stationary position about the respective cylinder axis of rotation, and follower means on each said crank arm engaging the respective said raceway for its cylinder for moving said crank arm as said follower means is pulled by said crank arm through said raceway during rotation of the respective cylinder, said raceway being shaped and positioned to move said crank arm and rotate said tucker blade on its mounting means to retract and remove the blade from possible contact with the web as the rotating cylinder carries the blade around the cylinder after tucking the web into the opposed cooperating gripper means, and (c) a brush extending substantially from one end of the cylinder to the other and means mounting said brush at the cylinder surface near and parallel to the tucker blade on said tucker blade mounting means for moving the brush thereon to a position extending farther beyond the cylinder surface, when the tucker blade is moved to said retracted position, than the tucker blade extends when in said first position.

3. In apparatus for zig-zag folding a flexible web, including a pair of driven cylinders disposed in parallel adjacent relation and adapted to receive the web therebetween, cooperating tucker blade and gripper means on each cylinder and effective to fold and tuck the web alternately into the gripper means on alternate cylinders at longitudinally spaced intervals along the web in response to rotation of the cylinders, the stripper means cooperating with the gripper means for releasing and guiding the folded web from the gripper means and the cylinders, the improvement comprising:

(a) means mounting each tucker blade for retracting and extending movement at the surface of its respective cylinder, (b) means for moving each tucker blade from a first position projecting beyond the surface of its respective cylinder for tucking a portion of the web into the gripper means on the other cylinder, to a second position retracted substantially flush with the surface of its respective cylinder as it moves with its respective rotating cylinder beyond a position adjacent the gripper means on the other cylinder, to retract and remove each blade from possible contact with the web as the rotating cylinders carry the blade around the cylinder after tucking the web into the cooperating gripper means, (c) a compliant sweeper, and (d) means mounting said sweeper at a cylinder surface near a tucker blade and means within that cylinder for cyclically moving the sweeper to an extended position extending beyond the cylinder surface for contacting the web when the tucker blade is moved to said retracted position and for maintaining said sweeper in said position extending beyond the cylinder surface after the gripper means on that cylinder has released the web thereon, for continuing to contact the web to aid the separation of the web from the cylinder surface and to protect it from the tucker blade.

4. The apparatus of claim 3 wherein said compliant sweeper is a brush which extends substantially from one end of the cylinder to the other substantially parallel to the tucker blade.

5. The apparatus of claim 4 wherein said brush is mounted on said tucker blade mounting means and is movable by said tucker blade moving means for moving the brush to said position extending beyond the cylinder surface when the tucker blade is moved to said retracted position.

* * * * *